US005337901A

United States Patent [19]

Skaer

[11] Patent Number: 5,337,901

[45] Date of Patent: Aug. 16, 1994

[54] PROCESS FOR SCREENING GRANULES

[75] Inventor: Dean A. Skaer, Little Rock, Ark.

[73] Assignee: Minnesota Mining and Manufacturing Company, St Paul, Minn.

[21] Appl. No.: 836,088

[22] Filed: Feb. 14, 1992

[51] Int. Cl.[5] ..... B07B 1/28; B07B 13/00

[52] U.S. Cl. ..... 209/315; 209/314; 209/317; 241/80

[58] Field of Search ..... 209/309, 311, 314, 315, 209/317; 241/80, 81, 97

[56] References Cited

U.S. PATENT DOCUMENTS

| | | | |
|---|---|---|---|
| 4,107,035 | 8/1978 | Foresman | 209/315 X |
| 4,430,211 | 2/1984 | Martin | 209/314 |
| 4,844,349 | 7/1989 | Kanda et al. | 241/80 X |
| 4,867,383 | 9/1989 | Terry et al. | 241/80 X |

FOREIGN PATENT DOCUMENTS

| | | | |
|---|---|---|---|
| 1441632 | 10/1966 | France | 209/315 |
| 0417182 | 7/1974 | U.S.S.R. | 209/315 |

OTHER PUBLICATIONS

Megatex Grain Cleaners, Catalog 918 (1989).
J & H Systems, Vibrating Screens, Systems 100 Mod 3.
Ty-Speed Screens, W. S. Tyler.
Ty-Speed Technical Data & Specifications, W. S. Tyler.
Combustion Engineering, Sprout-Bauer Roto-Shaker Screeners, 4370, SB-2/88-7500.
Derrick High Speed Screening Machines, DS 684 (1985).
Derrick Wet Sizing & Dewatering Screens, WS 1120.
Tested Performance of Derrick High Speed Screens on Dry Materials, Bulletin DT-186.
The Derrick Model K&B Multifeed Wet Sizing Screens, KB-0186.

*Primary Examiner*—D. Glenn Dayoan
*Assistant Examiner*—Tuan N. Nguyen
*Attorney, Agent, or Firm*—Gary L. Griswold; Walter N. Kirn; Mark W. Binder

[57] ABSTRACT

An apparatus and process for screening a product grade of particulate matter from a feed-stream of particulate matter is provided. Specifically, the apparatus is a vibration screening action machine which vibrates, including motion having a component thereof perpendicular to the plane of the screen deck, at least one screen deck having a mesh defining the lower limit of the product grade. Such vibration screening action machine is optimized for ensuring the throughput of particulate fines through the mesh defining the lower limit of the product grade and thus substantially removing particulate fines from the product grade by setting the screen deck at a relatively low angle, as measured from horizontal, of less than 15 degrees.

5 Claims, 2 Drawing Sheets

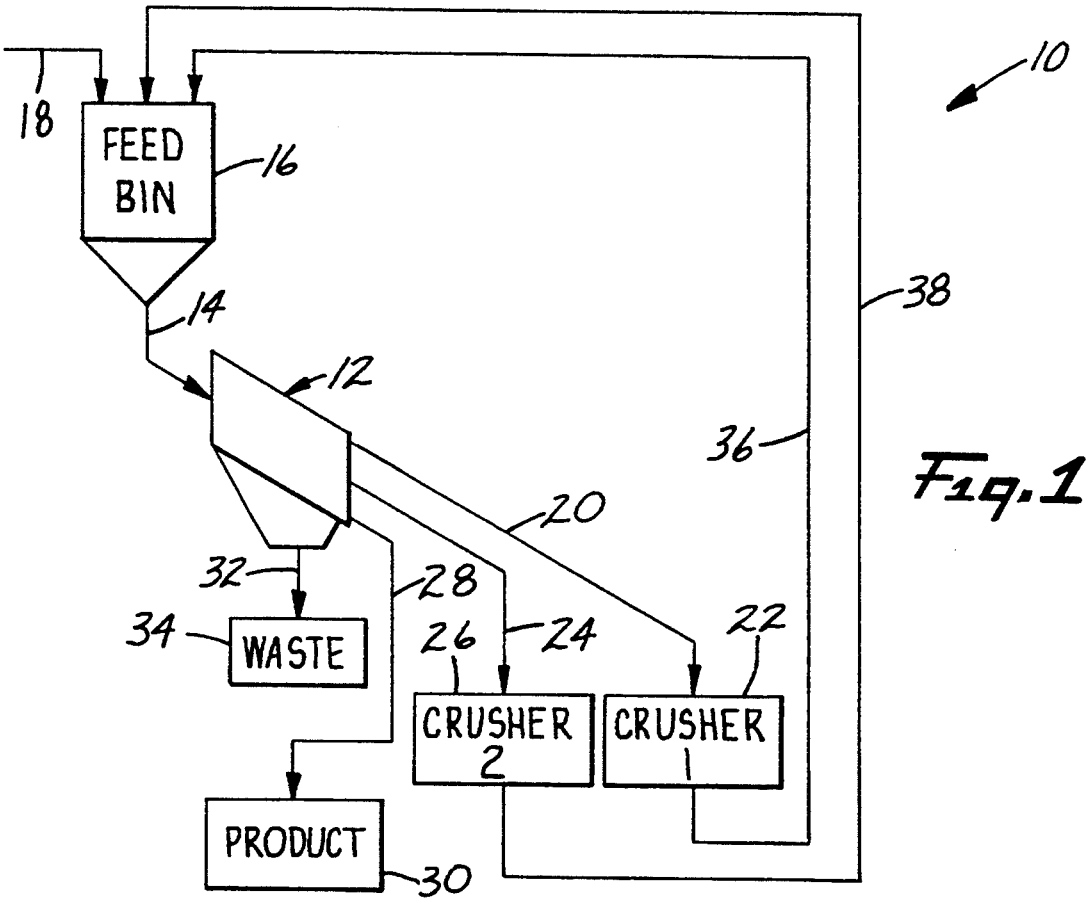
Fig. 1
Fig. 3
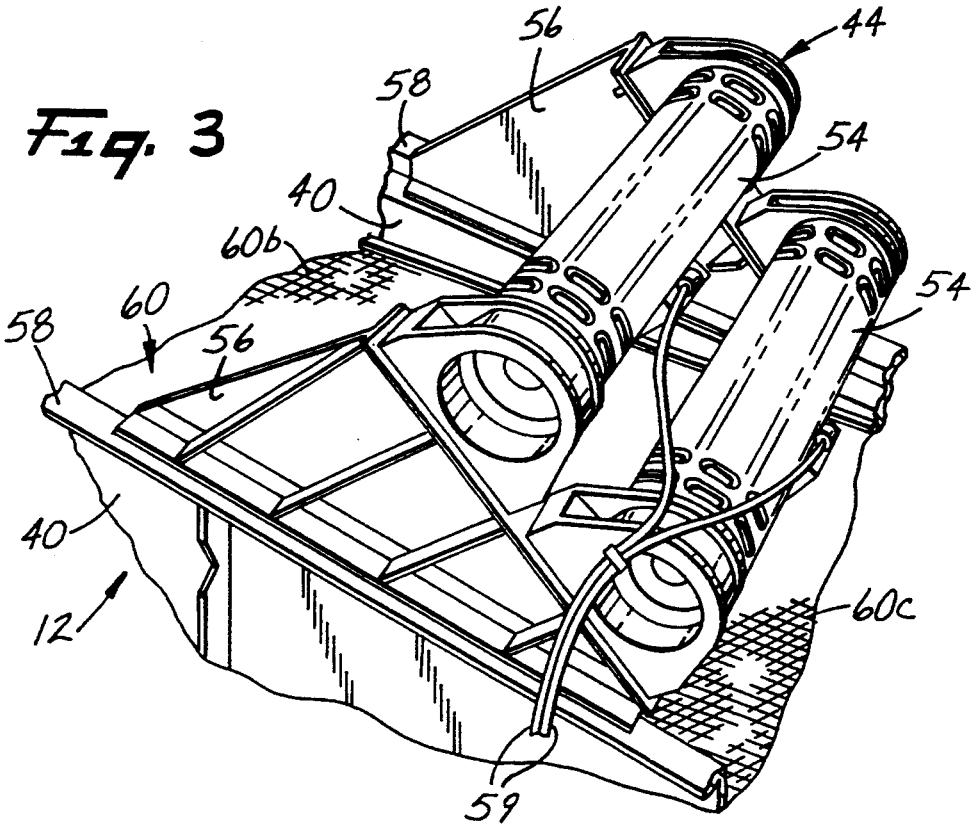

PROCESS FOR SCREENING GRANULES

TECHNICAL FIELD

The present invention is related to an apparatus for screening dry particulate matter so as to sort such incoming particulate matter into a plurality of size grades. More particularly, the present invention includes a process and apparatus for optimizing such screening to minimize unwanted fine material, hereinafter referred to as "fines", in the product grade matter.

BACKGROUND OF THE INVENTION

The basic problem to which the present invention is addressed is the classifying or sorting of particulate matter into certain size grades. The present invention is particularly applicable to mineral particulates, hereinafter referred to as granules, which are sorted so that a specific product grade granule is removed a feed stream of mineral granules. Granules larger than the product grade are sorted out and may be further processed and/or recirculated within the feed stream. The fines which are smaller than the product grade are also to be removed from the product grade granules.

It is particularly desirable to remove all, or at least as much as possible, of the fines from the product grade granules when such product grade granules are going to be subjected to further treatments or processing. Treating unwanted fines within the product grade granules increases the costs of treating and producing the product grade granules because such processing or treatments are also applied to the fines which are unusable as a product grade granules.

In one specific technology, namely the production of colored granules for use as roofing granules to be applied to roofing, such as shingles, it is highly desirable to remove the mineral fines from the product grade granules because of the expense in coating each of the granules with a specific pigment layer. Such pigments are normally applied within a ceramic coating. Moreover, specific grade granules are required for proper application of the roofing granules to roofing products, such as shingles, as such granules not only provide the aesthetic qualities to the end roofing product, but also protect the materials which comprise the roofing products, such as the asphalt-base of a shingle.

Many different methods and apparatuses are known for classifying particulate matter including dry sorting and wet sizing. The present invention is specifically directed to the field of dry screening processes and apparatuses. In a dry screening apparatus, a feed stream of particulate matter, such as mineral granules discussed above, is fed to the machine at an input end thereof, the particulate matter travels over at least one screen having a predetermined opening size (mesh), and the particulate matter that falls through the screen openings is collected for one purpose, while the material that doesn't fall through the screen is collected to be otherwise used. The particulate matter may travel over the screen under the influence of gravity, the influence of motion imparted thereto by the machine, a combination of such forces, or some other externally applied force.

When utilizing gravity, at least partially, to move the particulate matter over the screens, the apparatus must be set to dispose the screen at a sufficient angle from horizontal so that the particulate matter flows over the screen. Moreover, the screens must be pitched at an angle sufficiently steep for thinning the particulate matter after it is fed onto the screen so that the particulate matter thins and spreads out over the screen to ensure that the smaller particles are given the opportunity to pass through the screen openings. In other words, the pitch of the screen affects the rate and evenness of the traverse of the particulate matter over the screen to ensure such proper sorting. If the screens are too flat, the particulate matter becomes sluggish acting and the smaller particles are blocked from passing through the mesh of the screen by the larger particles lying on the screen, and thus the screening is ineffective.

One type of machine that has been particularly applied in the field of classifying mineral particulate matter for use in making roofing granules, is a screening machine sold by Rotex Company of Cincinnati, Ohio. Known examples includes Series 50 and 70 machines. The Rotex made machines are known to include plural screen layers, each screen layer having a different mesh size, for use in sorting mineral particulate material and specifically to remove roofing granules as product from the screening machine.

Typical roofing granules are known as 11 grade product, which means that the highest percentage of granule grade will pass through a 10 mesh (Tyler, opening size 0.065 inch, 1.68 mm) screen but will be retained on a 14 mesh (Tyler, opening size 0.046 inch, 1.19 mm) screen.

Moreover, such Rotex made machines rely on an orbital movement of the feed end of the screening machine, and specifically the screens therein. The orbital movement of each screen is substantially within the plane of each screen. Furthermore, such machines are typically set so that the plane of each screen is at an angle from horizontal primarily at about four degrees. The discharge end of such machines slides reciprocably along a substantially horizontal path as the feed end moves orbitally. Since the screens are set substantially flat, the orbital movement of each screen is responsible for dispersing the granules over the screen and traversing the granules along the screen to obtain the necessary throughput of granules. Such orbital movement at the feed end of the machine is thus relatively very substantial to ensure proper throughput of granules. A typical Series 50 model Rotex made machine having dimensions of approximately 40 inches by 120 inches moves about 3.5 inches at the feed end of the machine.

Another type of screener for sorting dry particulate materials is that using a vibration screening action. Vibration screening action means that the screens are not limited to movement substantially within the planes of each screen, but also include a component of movement in the direction perpendicular to the plane of the screens. That is, the screens are rapidly moved into and out of the plane of the screen at rest. Moreover, such vibrating screening action requires a much shorter displacement of the screens, typically about 0.625 inch, which is in the order of about 0.2 of the displacement of a Rotex type machine.

Vibration screening machines, however, require a significantly steeper angle of the screens to cause the particulate matter that is fed to the machine to be evenly displaced over the screens to ensure proper throughput of granules and fines. Typically, such machines are set at between 25°–50° from horizontal, although certain very light particulate materials such as plastics, for example polypropylene, may be as low as 15°–25°. Such machines are known to include one or more decks of vibrating screens. Known vibration screening action machines are available from Derrick Manufacturing Corporation of Buffalo, N.Y., which may be provided with one, two or three screening decks.

Heretofore, such vibration screening action machines have been found to be ineffective in the field of sorting mineral particulates, particularly for roofing granules, where it is desirable to substantially eliminate mineral fines within the product grade. Preferably, the weight percentage of mineral fines within the product grade should be below one percent. The combination of the vibrating action and the angle of the machine necessary to evenly disperse the mineral particulate generally resulted in too high a concentration of mineral fines within the product grade. In other words, as the product is taken off of the product grade defining screen deck, a substantial amount of the mineral fines was not passing through such screen. For example, when sorting 11 grade product from mineral particulate in the making of roofing granules, it was found that, in general, 1.5% or greater of mineral fines was present within samples of the 11 grade product as output of the vibration screening action machine. In contrast, the percentage of mineral fines making up such 11 grade material as product from a Rotex type machine was found to be, in general, below 1%. Of course, such percentages depend greatly on many other operating conditions which may affect the percentage of mineral fines within the product grade. Such operation conditions include the type of mineral ore, the crushing or recrushing techniques of the mineral ore before screening and the blinding or blocking of the screen mesh. Such results, however, were obtained under similar operating conditions comparing a Rotex type screening machine as described above to a vibration screening action machine available from Derrick Manufacturing Company, noted above, set at an angle of 15° from horizontal.

In accordance with the conventional knowledge and understanding of vibration screening action machines, it follows that in order to improve the throughput of the mineral fines through the mesh of the screen defining the lower limit of the product grade, a steeper angle of the machine would be required to more evenly distribute the mineral particulate over each screen so that as a particulate matter traverses the screens the layer of particulate matter is sufficiently thin so that the mineral fines have ample opportunity to fall through the mesh of the relevant screen. The basic problem being that the mineral fines were not being given the opportunity to fall through the relevant screen openings because they were blocked by the larger particles which ride on the screen.

SUMMARY OF THE PRESENT INVENTION

The present invention overcomes the shortcomings and disadvantages of prior art dry screening machines by providing a vibration screening action machine that satisfactorily reduces the concentration of mineral fines within product grade granules. Thus, the reduction in mineral fines corresponds to a savings in overall granule processing in that mineral fines are not unnecessarily treated. Moreover, as a result of significantly shorter machine movements, such vibration screening action machines require less maintenance than the orbital type screening machines, and the vibration screening action machines result in significantly lower vibration of the machine surroundings including the floor and building housing such machines.

In the processing of roofing granules, which are coated with opaque pigments in order to shield asphaltic roofing materials from ultraviolet light and also to provide an aesthetically pleasing appearance, it is critical to maintain the concentration of fines within the product grade as low as possible to avoid unnecessary costs associated with granule coating. It has been found each one percent of mineral fines results in approximately 6% increased usage of expensive coloring pigments. Another advantage of reduced mineral fines is that there is less dust associated with the processing operations thereby reducing environmental problems.

The aforementioned benefits and advantages are achieved by a vibration screening action machine for sorting product grade granules from a feed-stream of product containing particulate matter. The vibration screening action machine includes at least one screen deck having a mesh defining a lower limit to the size of product granules sorted from the feed-stream of particulate matter and a means for imparting vibratory motion, that is motion at least having a component of movement perpendicular to the plane of the screen, to the screen deck.

Moreover, the vibration screening action machine is set so that the at least one screen deck is maintained at an angle of less than 15° from horizontal. By maintaining the screen deck or decks of the subject vibration screening action machine below 15°, it was unexpectedly discovered that less mineral fines were present in the product grade granules. Contrary to the conventional procedures and understanding of such machines, noted above in the Background section of this application, which would suggest increasing the angle of the machine to enhance throughput of the mineral fines by improving the opportunity for the mineral fines to pass through the screens, it was unexpectedly discovered that by reducing the angle of the screens, as measured from horizontal, the throughput of mineral fines was improved.

Such improvement in the percentage of mineral fines present in the product grade has proved to be true even though the reduction in angle tends to increase the thickness of the layer of particulate matter traversing the screen which is known to hinder the passage of the mineral fines through the screen because of the blocking of the mineral fines by larger granules that ride on the relevant screen. It is believed that even though such hindering to the passage of mineral fines must occur, that the increased time that the particulate matter is on the screen combined with the vibratory motion overcomes such hindering and in fact improves the total throughput of mineral fines. Moreover, the vibratory motion is believed to cause natural segregation of the particulate matter as it traverses the screen over time with the fines stratifying nearest the screen. By flattening the screens, the traverse time is increased enough for such natural segregation to occur and for the fines to fall through the screen.

The present invention is also directed to the processing of particulate matter by a vibration screening action machine so as to sort product grade granules from a feed-stream of particulate matter. The process includes the steps of providing a vibration screening action machine having at least one screen deck which defines the lower limit of product size of the product grade granules and a means for imparting vibratory motion, that is motion including at least a component thereof in the direction perpendicular to the plane of the screen, to the screen deck, and setting the screen deck at angle of less than 15° from horizontal. The process further includes supplying a feed-stream of product containing particulate matter to the vibration screening action machine, vibrating the at least one screen deck by the vibration means, transversing the particulate matter containing the product grade granules across the at least one screen deck, and collecting the product grade granules from the upper surface of the at least one screen deck. Also, the mineral fines which pass through the mesh of the at least one screen deck are collected as waste.

It is further contemplated to use such a vibration screening action machine together with one or more crushing stations. In this case, plural screen decks are provided of decreasing mesh size from the top of the machine to the bottom, whereby particulate matter above the upper limit of the product grade granules can be conveyed to a crushing station and refed with the feed-stream of particulate matter. Otherwise, the larger granules could be otherwise used or processed in any other way. Preferably, the vibration screening action machine of the present invention comprises three screen decks with the largest particulate matter coming off the top screen and going to a first crushing station, the particulate matter coming off the second screen going to a second crushing station, the product grade granules coming off the third screen deck, and the mineral fines coming from the machine pan to be collected as waste.

BRIEF DESCRIPTION OF THE DRAWINGS

FIG. 1 is a schematic diagram illustrating the referred process of using a vibration screening action machine for producing product grade granules and collecting mineral fines as waste;

FIG. 3 is a partial top view, in perspective, of the machine of FIG. 2.

DETAILED DESCRIPTION OF THE PREFERRED EMBODIMENTS

Figure 2:
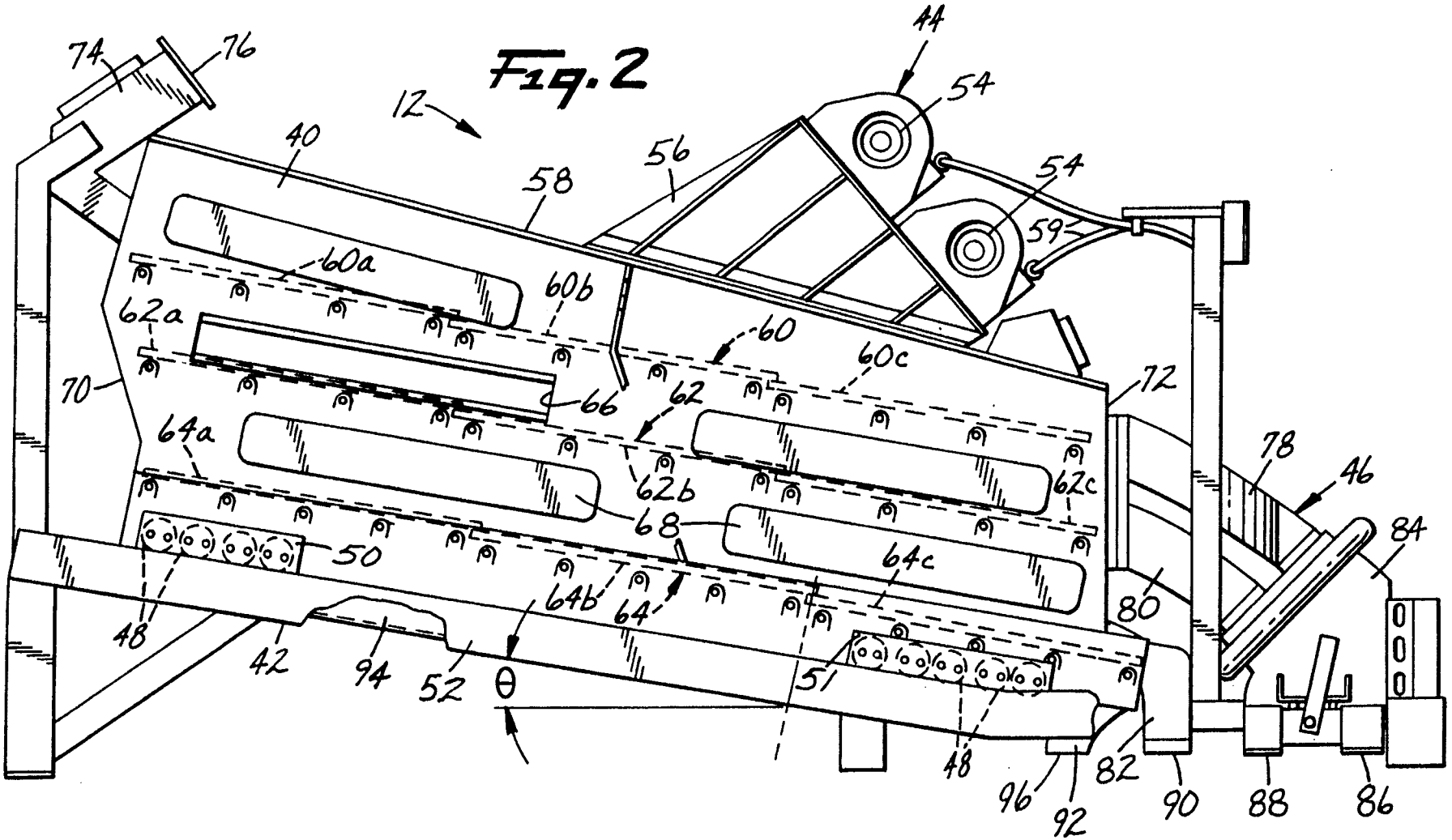
FIG. 2 is side view of the vibration screening action machine of the present invention showing the setting of the machine and thus the screen decks therein at a specified angle to optimize mineral fine throughput.

Referring now to the figures, wherein like numerals are used to designate like components throughout each of the several figures, and in particular to FIG. 1, a process circuit 10 is schematically illustrated including a screening machine 12 which is used for sorting product grade granules from a feed-stream of particulate matter. The feed-stream of particulate matter is illustrated at 14 running from a feed bin 16 to the screening machine 12. The feed-stream of particulate matter 14 can be fed to the screening machine 12 by any conventional conveying means, such as by conveyor belts, through conduits, or the like. The feed bin 16 is supplied with new particulate matter by a conveying means showing at 18, which initially supplies particulate matter to the feed bin 16 and thereafter introduces new particulate matter to the circuit 10 as product grade granules and waste are produced.

The feed-stream of particulate matter 14 is separated and classified by the screening machine 12 into a plurality of outputs, of which there are preferably four in accordance with the preferred embodiment of the present invention described below. Specifically, line 20 is shown connecting from the screening machine 12 to a first crushing mechanism 22. Line 24 connects from the screening machine 12 to a second crushing mechanism 26. A third line 28 connects from the screening machine 12 to a product collecting vessel 30, and line 32 is connected from the screening machine 12 to a waste collecting bin 34. Lines 20, 24, 28 and 32 may comprise any conventional conveying means, such as by conveyor belts, through conduits, or the like.

As will be more clearly understood from the detailed description of the screening machine 12 below, each of lines 20, 24 and 28 come from one of three screen decks within the screening machine 12, and the line 32 connects from the pan or floor of the screening machine 12. The screen decks within the screening machine 12 are arranged with decreasing mesh (screen opening) sizes from the top of screening machine 12 to the bottom thereof. Thus, the particulate matter passing through line 20 is of a larger size than the particulate matter passing through line 24. Likewise, the particulate matter within both lines 20 and 24 are larger than the product grade granules which pass through line 28 to the product collecting vessel 30. The waste fines which collect in the pan of screening machine 12 are directed through line 32 to the waste collecting bin 34. Such fines comprise particles smaller in size than the product grade granules.

As discussed in the Background section of this application, it is extremely beneficial to remove substantially all of such fines from the product grade granules, specifically in cases where the product grade granules are to be subjected to further treatments. Such is the case in the process of preparing pigmented roofing granules which are conventionally known for application to roofing materials, particularly asphalt-based roofing materials such as shingles. Is important that the roofing granules be sized in accordance with set standards so that the appearance of the granules on the roofing product can be accurately controlled and so that such application can be done effectively. Such granules not only are used for aesthetic purposes, they also protect the asphaltic material from harmful ultraviolet rays which they would otherwise be subjected to and which reduces the lifetime of such roofing products. Moreover, in the case of roofing granules, the product grade granules are preferably coated with opaque pigments. The pigments are often substantially more expensive than the granules themselves. Thus, it is important to keep the pigment portion to a minimum but which will provide the desired ultraviolet protection and aesthetic appearance. Tests have established that each one percent of fines within the product grade granules results in approximately 6% increased usage of the expensive coloring pigments. Clearly, there is a desire to reduce such fines to reduce overall costs. Moreover, removing the fines also results in less dust which means less environmental problems.

Thus, it is an important factor in designing the screening machine 12 for use in the process circuit 10 so that the fines are most effectively removed from the product grade granules, and to do so as quickly as possible. In other words, it is most desirable that as much as possible of the fines pass through all of the screen decks within the screening machine 12 on a single pass of the particulate matter through the screening machine 12.

Further in accordance with the preferred circuit 10 of the present invention, lines 36 and 38 comprise conventional conveying means connecting the first and second crushing mechanisms 22 and 24, respectively, to the feed bin 16. Thus, with respect to particulate matter larger than the product size which exits the screening machine 12 through either of lines 20 or 24, the circuit 10 is a closed circuit. Such larger particulate matter is crushed by the first and second crushing mechanisms 22 and 26, respectively, so that as it is fed back into the feed bin 16 and refed to the screening machine 12 through the feed-stream 14, it will again be sorted and product grade granules will be removed. As a result of the closed circuit system, once the circuit 10 is up to a chosen running capacity, the conveying means 18 should supply as much new particulate matter as that which is taken from the system as product grade granules and waste.

The first and second crushing mechanisms 22 and 26 can comprise any conventionally known crushers, such as cone crushers, roll crushers, or the like, which are commercially available. The first and second crushing mechanisms 22 and 26 can be similar crushers, or may comprise different crushers specific to the size of particulate matter fed thereto. Moreover, if only a two deck screening machine 12 is used, only one crushing mechanism would be needed.

In a similar sense, the particulate matter taken from the screening machine 12 that are larger than the product grade granules can be disposed of or otherwise used in any other process if it is not desirable to recrush the particulate matter or if there are other intended uses thereof.

Referring now to FIG. 2, the details of the screening machine 12 will be more specifically described. The screening machine 12 basically comprises a screen supporting body 40, a support base 42, a vibration generating means 44 and a chute system 46. The screen supporting body 40 is movably connected to the support base 42 by a plurality of mounting blocks 48, preferably provided at the four corners of the screen supporting body 40. More specifically, the mounting blocks 48 preferably comprise a resilient material such as rubber and are fixed with flanges shown at 50 and 51 which are further fixed with side beams 52 of the support base 42. The resilient mounting blocks 48 are fixed at their other end with the screen support body 40. It is necessary that the mounting blocks 48 comprise some sort of resilient material so as to permit limited relative movement to the degree of vibration generated of the screen support body 40 to the support base 42. More or less of such mounting blocks 48 can be provided depending on the degree of vibration and movement of the screen supporting body 40 relative to the support base 42. It is also understood that other resilient connections could be substituted for the mounting blocks 48 which permit the needed limited movement.

As best seen in FIG. 3, the vibration generating means 44 preferably comprises a pair of electrical three-phase induction vibration motors 54 that deliver high speed centrifugal force or impact to the screen supporting body 40. Such vibration motors 54 are rigidly connected with the screen supporting body 40 at both sides thereof by mounting plates 56 connected with the upper side edges 58 of the screen supporting body 40. Thus, as the vibration motors 54 are caused to vibrate by supplying power to each of the vibration motors 54 by power lines 59, the vibration thereof is transmitted through the mounting plates 56 and to the screen supporting body 40. Furthermore, since the screen supporting body 40 is movably supported to the support base 42 by way of the resilient mounting blocks 48, the vibratory motion of the screen supporting body 40 is permitted while the screen supporting body 40 is generally held in place, at least with respect to the angle that the screen supporting body 40 is disposed, as will be further explained below.

Referring again to FIG. 2, the screen supporting base 40 supports at least one screen deck which extends substantially entirely over the longitudinal length of the screen supporting body 40. At least one such screen deck is necessary having a mesh defining a lower limit to the size of product granules to be sorted from the feed-stream of particulate matter. Additional screen decks may be provided as desired for removing other sizes of particulate matter for recycling within the machine circuit 10, as discussed above, or for other uses.

Preferably, the screen supporting body 40 supports a first screen deck 60, a second screen deck 62, and a third screen deck 64. The first screen deck 60 is preferably divided into screen deck portions 60*a*, 60*b* and 60*c*; the second screen deck 62 is preferably divided into screen deck portions 62*a*, 62*b* and 62*c*; and the third screen deck 64 is preferably divided into screen deck portions 64*a*, 64*b* and 64*c* so that the screen deck portions can be more easily placed in and removed from the screen supporting body 40 through access openings 66 provided at strategic locations of the sidewalls on the screen supporting body 40. The access openings 66 are covered with removable covers 68 that close off the access openings 66 during operation of the screening machine 12. One of such access openings 66 is illustrated in FIG. 2 with its cover 68 removed just above the second screen deck 62 at the uphill portion thereof. The covers 68 may comprise any type cover that is removably mounted to the screen supporting body 40 to cover such access opening 66, including the use of quick connect devices or resilient materials which deform and connect over flanges or the like.

The first, second and third screen deck 60, 62 and 64, respectively, are preferably disposed substantially parallel with one another and at an angle from horizontal so that particulate matter will traverse over each screen deck from the uphill side 70 of the screen supporting body 40 to the downhill side 72 thereof. The specific range of suitable angles will be described below. The screen deck portions 60*a*, 60*b*, 60*c*, 62*a*, 62*b*, 62*c*, 64*a*, 64*b* and 64*c* are each preferably mounted independently to the sidewalls of the screen supporting body 40 so that each screen deck portion is independently removable. Any conventional means can be utilized for connecting each screen deck portion to the sidewalls of the screen supporting body 40, and such connecting means preferably comprises conventional, mechanical connectors, such as bolts which pass through the sidewalls of the screen supporting body 40 and screw into side flanges integral with the screen deck portions. A plurality of such bolts are illustrated for each of the screen deck portions. The screen deck portions 60 *a, b* and *c*, 62 *a, b* and *c*, and 64 *a, b* and *c* also preferably overlap each other at the facing ends thereof so as to create a slightly stepped screen deck surface over which the particulate matter will traverse.

In order to feed particulate matter to the upper surface of the first screen deck 60 at or near the uphill side 70 of the screen supporting body 40, and infeed chute 74 is provided which is mounted to the screen support base 42. The uphill side 70 of the screen supporting body 40 includes an opening (not shown) through which the particulate matter passes from the infeed chute 74 to the top surface of the first screen deck 60. Since the infeed chute 74 is fixed with the support base 42, it does not vibrate with the screen supporting body 40 under the influence of the vibration motors 54. Thus, an appropriate flexible connection is preferably provided between the outlet opening (not shown) of the infeed chute 74 and the opening through the uphill side 70 of the screen supporting body 40. The infeed chute 74 could just as easily be fixed with the conveying means (not shown) which brings the particulate matter to the screening machine 12 to be processed. Alternately, the infeed chute 74 could be fixedly mounted to the screen supporting body 40, and a flexible connection could be conventionally provided between the inlet opening 76 thereof and the conveying means (not shown) that supplies the particulate matter.

At the downhill side 72 of the screen supporting body 40, the chute system 46 is provided which is preferably connected with the downhill side 72 of the screen supporting body 40 so as to vibrate with the screen supporting body 40. Such connection can comprise any conventional connection means. The chute system 46 preferably comprises a first chute 78 which is positioned to receive particulate matter as it exits the downhillmost edge of the screen deck portion 60*c* of the first screen deck 60. In other words, as the particulate matter that doesn't fall through the mesh of the first screen deck 60 falls from the downhillmost edge of the screen deck portion 60*c*, it falls into an inlet opening of the first chute 78. Such inlet opening is appropriately configured and positioned to receive all of such matter. Likewise, a second chute 80 is provided as part of the chute system 46 for catching the particulate matter that does not pass through the second screen deck 62 which falls from the downhillmost edge of the screen deck portion 62*c*. Furthermore, a third chute 82 is provided which catches the product grade granules that do not fall through the third screen deck 64 at the downhillmost edge of the screen deck portion 64*c*. The first, second and third chute 78, 80 and 82, respectively, are preferably connected with one another by a housing 84 for stability.

The first chute 78 terminates at an outlet opening 86 thereof from which the particulate matter off the first screen deck 60 is discharged. The second chute 80 terminates in an outlet opening 88 from which the particulate matter of the second screen deck 62 is discharged. The third chute 82 likewise terminates in an outlet opening 90 from which product grade granules off the third screen deck 64 are discharged. The outlet openings 86, 88 and 90 are preferably disposed so that the particulate matter and product grade granules discharged therefrom are discharged into or onto appropriate conveying means for transferring such materials in accordance with the desired process circuit.

A fourth chute 92 is also provided opening through the floor or pan 94 of the screen supporting body 40 at the downhill end thereof. Thus, particulate matter which falls through all three of the screen decks 60, 62 and 64, known as fines, can exit the screen supporting body 40. The fourth chute 92 includes an outlet opening 96 from which such fines are discharged to an appropriate conveying means for disposal or other use. Such fines are collected by the pan 94 and moved downhill to the fourth chute 92 and through the outlet opening 96.

The screening machine 12, as described above and with exception to the specific orientation of the machine as set up for usage, is commercially available from Derrick Manufacturing Corporation of Buffalo, N.Y., including the vibration motors 54. Such vibration motors 54, as available, comprise three-phase induction motors and rotating eccentric bearing housings. When two such vibration motors 54 are used, it is preferable to rotate the eccentric bearings in opposite rotational directions from one another.

The action of such vibration screening action machines, as driven by the vibration motors 54 includes movement of the screen decks 60, 62 and 64 to at least some degree in a direction including at least a component of such movement in the direction perpendicular to the plane of each screen deck. In other words, the vibratory motion is not entirely within the plane of the screen decks. Such vibratory motion can be substantially reciprocable, as shown by the arrows at point X shown in FIG. 2. Such motion could also be elliptical. It is, however, preferable that such vibratory motion causes the particulate matter to move downhill across screen decks 60, 62 and 64. Such movement is controlled by the vibration motors 54, the positions thereof with respect to the screen supporting body 40, the speed of rotation, and the relative directions of rotation.

Moreover, the use of such machines, including a three deck screening system for sorting mineral particulate matter in the making of roofing granules has been previously attempted. Such use, however, proved unsatisfactory in that too high a percentage of fines were retained within the product grade granules. Such fines within the product grade granules, as amplified above, can greatly increase the costs associated with any further processing of the product grade granules. In such previous attempt, the screen supporting body 40 was disposed relative to the support base 42 such that the screen decks 60, 62 and 64 were disposed with angle $\theta$ set at 15°.

Roofing granules, as processed and screened as above, comprise mineral particulate matter that is produced from raw mineral ore. Roofing granules of mineral ore are characterized by bulk densities in the range of between 60 and 120 lbs./ft$^3$. Furthermore, the specific gravity of such mineral ore generally ranges between 2.55 and 3.05. Such mineral ore is preferably crushed by conventional crushing means to produce particles of a suitable size usable as roofing granules, which, as defined above, is preferably 11 grade.

During such previous attempt, representative samples of product grade granules were taken as they exited the outlet opening 90 of the third chute 82 and the composition make up of particle sizes was determined. Table 1 below shows the weight percent of granules retained on screens of meshes between 10 mesh and 35 mesh, and the percentage of fines which are smaller than 35 mesh and which are noted as "pan". The mesh sizes used within Tables 1 and 2 of this application refer to meshes of the Tyler scale. The opening sizes for each mesh is as follows: 10 mesh–0.065 inch (1.68 mm); 14 mesh–0.046 inch (1.19 mm); 20 mesh–0.0328 inch (0.841 mm); 28 mesh–0.0232 inch (0.595 mm); and 35 mesh–0.0164 inch (0.420 mm). Moreover, 11 grade roofing granule samples, which is the preferred product grade granules means the highest percentage of granule grade will pass through 10 mesh (Tyler) screen but will be retained on a 14 mesh (Tyler) screen. See the second column of Table 1.

Such representative samples generally show that the percent of pan material, fines, is above 1%, which is unacceptable. Of course, during the taking of such representative samples, other pan values were obtained both higher and lower than those shown, but which were believed adversely affected by other operating parameters. Such other operating parameters include the blinding or blocking of one or more of the screen decks, the processing of abnormally high fine content particulate matters, or the effects of other machines or circuits thereof which when operational or not affect the quality of particulate matter within the system circuits.

TABLE 1

| Percent (Weight) Retained on Each Screen | | | | | |
|---|---|---|---|---|---|
| 10M | 14M | 20M | 28M | 35M | PAN |
| 9.5 | 36.7 | 30.1 | 19.6 | 3.2 | 1.0 |
| 11.2 | 35.9 | 28.9 | 19.0 | 3.5 | 1.5 |
| 11.9 | 36.9 | 28.9 | 18.1 | 3.1 | 1.1 |
| 10.3 | 35.3 | 30.5 | 19.7 | 3.1 | 0.8 |
| 5.0 | 36.5 | 29.7 | 19.2 | 2.1 | 1.1 |
| 10.4 | 35.7 | 29.2 | 14.4 | 3.7 | 1.3 |
| 11.6 | 32.4 | 29.5 | 20.7 | 4.9 | 2.3 |
| 7.5 | 32.6 | 32.9 | 22.4 | 4.3 | 1.1 |
| 10.1 | 32.9 | 27.9 | 18.9 | 4.6 | 2.3 |

In accordance with the present invention, and contrary to the conventional procedures and understanding of such vibration screening action type machines, applicants discovered that by maintaining the screen decks 60, 62 and 64 at angles less than 15° from horizontal provides unexpectedly low percentages of fines within the product grade granules. Conventional procedures and understanding of such vibration screening action machines, as discussed above in the Background section of this application, suggests that it would be necessary to increase the angle from horizontal of the screen decks in order to enhance throughput of the particulate fines by improving the opportunity for the particulate fines to pass through the screens, by decreasing the thickness of particulate matter on the screens. Thus, the fines would traverse over the screens and fall through.

In contrast, the improvement in the reduction of particulate fines within the product grade granules has proved to be true even though the reduction in angle tends to increase the thickness of the layer of particulate matter that traverses the screen, which tends to hinder the passage of particulate fines because of the blocking to the passage of particulate fines by the larger granules that don't pass through the mesh of the product defining screen. It is believed that even though the passage of particulate fines must be hindered by the increased thickness of the particulate matter layer, that the increased time that the particulate matter traverses the screen combined with the vibratory motion of such screening machine 12 overcomes such hindering and in fact improves the throughput of the particulate fines. Moreover, the vibratory motion is believed to cause natural segregation of the particulate matter as it traverses the screen over time with the fines stratifying nearest the screen. By flattening the screens, the traverse time is increased enough for such natural segregation to occur and for the fines to fall through the screen.

Representative samples obtained in a similar manner as that described above with respect to Table 1 were taken during the sorting of product grade roofing granules on a screening machine 12 disposed with the angle $\theta$ at 10°. In the same sense as the samples taken for the 15° machine, such values are dependent on the other operating conditions which occasionally result in values higher and lower than those of Table 2 below. It is, however, believed that the general trend of a substantially reduced percentage of pan particulate fines is established.

TABLE 2

| Percent (Weight) Retained on Each Screen | | | | | |
|---|---|---|---|---|---|
| 10M | 14M | 20M | 28M | 35M | PAN |
| 8.5 | 38.4 | 28.4 | 20.7 | 3.1 | 0.9 |
| 8.1 | 39.3 | 29.4 | 21.2 | 1.8 | 0.3 |
| 7.1 | 38.6 | 30.5 | 22.1 | 1.4 | 0.3 |
| 8.1 | 39.0 | 30.9 | 21.2 | 0.5 | 0.3 |
| 7.3 | 38.4 | 31.3 | 22.2 | 0.5 | 0.3 |
| 8.1 | 38.7 | 30.6 | 21.6 | 0.7 | 0.3 |
| 8.9 | 41.4 | 28.7 | 20.2 | 0.6 | 0.2 |
| 6.4 | 37.2 | 31.1 | 22.7 | 2.0 | 0.6 |
| 7.2 | 38.5 | 30.7 | 22.3 | 1.0 | 0.4 |

The same screening machine 12 was also operated for sorting roofing granules with the screen angle $\theta$ at 12°. Similarly, representative samples were taken from the product grade granules and the composition sizes thereof determined. Again, the results obtained were generally better than that of the 15° machine, but were not as good as the values obtained from the 10° machine. However, the trend was supported that lowering the angle $\theta$ below 15° actually increases the throughput of particulate fines through the product granule defining screen deck contrary to the conventional procedures and understanding of such vibration screening action machines.

It is understood that many other modifications or additions could be made to the apparatus and process of the present invention without departing from the spirit thereof, and that the scope of the present invention should not be limited by the specific features and steps of the apparatus and process of the present invention. In particular, the positioning of the screens of such a vibration screening action machine at angles below 15 degrees is applicable to other types of vibration screening action machines than that specifically disclosed and that utilize similar operating principles. Moreover, the trend that decreasing the angle of the machine below 15 degrees, as measured from horizontal, results in the increase of the throughput of fines is believed applicable to all angles below 15 degrees. However, as the machine becomes flatter, greater forces must be exerted on the machine to generate movement of the particulate matter over the screens. At some point the application of more force becomes impractical. Furthermore, the principles of the process and apparatus of the present invention are also applicable to other particulate matter than mineral particulate or granules since the effects of the vibratory motion and the reduced angle should be equally applicable to such other particulate matter, whether lighter or heavier, although the optimized angle may vary somewhat.

I claim:

1. A process of sorting roofing grade granules having a bulk density of between 60 and 120 lbs./ft.$^3$ and which will pass through a screen having an opening size of about 0.065 inch from a feed-stream of dry mineral particulate matter and substantially removing fine particulate matter smaller than about 0.0164 inch from the roofing grade granules, comprising the steps of:

providing a plurality of screen decks, each having at least a generally planar portion and a plurality of openings through the generally planar portion, the plurality of screen decks including a first screen deck that defines an upper limit of the roofing grade granules, and a second screen deck and a means for imparting vibratory motion having at least a component of such movement in a direction perpendicular to the plane of said screen deck to the screen deck;

setting the generally planar portion of the second screen deck at an angle, as measured from horizontal, at less than 15 degrees;

vibrating the plurality of screen decks while maintaining the generally planar portion of the second screen deck at the set angle;

supplying a feed-stream of mineral particulate matter to the vibration screening action machine;

traversing the mineral particulate matter across at least the plurality of openings of the generally planar portion of the first vibrating screen deck so that mineral particulate matter smaller than the upper limit of the roofing granule grade passes through the first screen deck to the second screen deck and transverses at least the plurality of openings of the second screen deck, thereby substantially removing the fine mineral particulate matter from the roofing grade granules by such fine mineral particulate matter falling thought the openings of the second screen deck; and collecting the roofing grade granules from an upper surface of the second screen deck.

2. The process of claim 1, further comprising the steps of collecting the particulate matter from the upper surface of each screen deck, and collecting the particulate matter that passes through the at least one opening that defines the lower limit of the roofing granule grade of particulate matter.

3. The process of claim 2, further comprising the steps of crushing particulate matter that is larger than the upper limit of the roofing granule grade of particulate matter, re-circulating crushed particulate matter back into the feed-stream of particulate matter, and re-supplying the crushed particulate matter for sorting.

4. The process of claim 2, wherein said step of setting the generally planar portion of the screen deck at an angle, as measured from horizontal, at less than 15 degrees further comprises setting a generally planar portion of each screen deck at substantially the same angle.

5. The process of claim 1, wherein said step of setting the generally planar portion of the screen deck at an angle further comprises setting a generally planar portion of each screen deck at substantially the same angle between 8 and 12 degrees.

* * * * *

UNITED STATES PATENT AND TRADEMARK OFFICE

CERTIFICATE OF CORRECTION

PATENT NO. : 5,337,901
DATED : August 16, 1994
INVENTOR(S) : Dean A. Skaer

It is certified that error appears in the above-indentified patent and that said Letters Patent is hereby corrected as shown below:

Col. 6, line 66, delete "24" and insert --26--.

Col. 11, line 20, before "In accordance . . ." insert the title --11 GRADE SAMPLES--.

Col. 12, line 13, before "The same screening . . ." insert the title --11 GRADE SAMPLES--.

Signed and Sealed this

Twenty-sixth Day of November 1996

*Attest:*

Bruce Lehman

BRUCE LEHMAN

*Attesting Officer*

*Commissioner of Patents and Trademarks*